US009562647B2

(12) United States Patent
Eide

(10) Patent No.: US 9,562,647 B2
(45) Date of Patent: Feb. 7, 2017

(54) CRYOGENIC FLUIDS TRANSFER SYSTEM WITH TRANSFER SPILLS CONTAINMENT

(75) Inventor: Jørgen Eide, Fana (NO)

(73) Assignee: Framo Engineering AS, Bergen (NO)

( * ) Notice: Subject to any disclaimer, the term of this patent is extended or adjusted under 35 U.S.C. 154(b) by 1097 days.

(21) Appl. No.: 11/795,472

(22) PCT Filed: Jan. 24, 2006

(86) PCT No.: PCT/NO2006/000031
§ 371 (c)(1),
(2), (4) Date: Sep. 18, 2008

(87) PCT Pub. No.: WO2006/080853
PCT Pub. Date: Aug. 3, 2006

(65) Prior Publication Data

US 2009/0071173 A1 Mar. 19, 2009

(30) Foreign Application Priority Data

Jan. 25, 2005 (NO) ..... 20050387

(51) Int. Cl.
*F17C 6/00* (2006.01)

(52) U.S. Cl.
CPC ..... *F17C 6/00* (2013.01); *F17C 2203/0375* (2013.01); *F17C 2203/0391* (2013.01);
(Continued)

(58) Field of Classification Search
CPC ..... F17C 6/00; F17C 13/082; F17C 3/025; F17C 1/002; F17C 2203/0192; F17C 2203/0375; F17C 2203/0391; F17C 2203/0643;F17C 2205/184; F17C 2225/0161; F17C 2227/0136; F17C 2260/057; F17C 2270/0009
(Continued)

(56) References Cited

U.S. PATENT DOCUMENTS 2,449,352 A 9/1948 White
3,159,004 A * 12/1964 Keith ..... F17C 3/025 62/53.2
(Continued)

FOREIGN PATENT DOCUMENTS

DE 1 289 759 2/1969
DE 26 30 342 1/1978
(Continued)

OTHER PUBLICATIONS

English translation of WO2004048191.*
Norwegian Office Action and Search Report for corresponding Norwegian Patent Application No. 20050387 dated Jan. 28, 2011.

*Primary Examiner* — Frantz Jules
*Assistant Examiner* — Brian King
(74) *Attorney, Agent, or Firm* — Merchant & Gould P.C.

(57) ABSTRACT

The present invention regards a system for transferral of at least one cryogenic fluid between two objects. At least one transfer pipe extending from the installation extends into a receiving room in the vessel, the transfer pipe being connectable with piping on the vessel through a connection in the receiving room. The receiving room is closable, the connection, and or at least a part of the construction forming the receiving room and or other elements in the receiving room are constructed to withstand eventual leakage of the cryogenic fluid and the system also provides for evacuating the receiving room for eventual spilled fluid. The invention also regards a flange for use in the system.

18 Claims, 6 Drawing Sheets

(52) U.S. Cl.
CPC *F17C 2203/066* (2013.01); *F17C 2203/0643* (2013.01); *F17C 2203/0646* (2013.01); *F17C 2205/0184* (2013.01); *F17C 2205/0192* (2013.01); *F17C 2225/0161* (2013.01); *F17C 2227/0135* (2013.01); *F17C 2260/037* (2013.01); *F17C 2270/0509* (2013.01)

(58) Field of Classification Search
USPC ..... 62/50.7, 53.2
See application file for complete search history.

(56) References Cited

U.S. PATENT DOCUMENTS

| | | | | |
|---|---|---|---|---|
| 3,236,267 | A | 2/1966 | Bily | |
| 3,428,013 | A * | 2/1969 | Prew | 114/74 A |
| 3,863,460 | A * | 2/1975 | Straile | B63B 25/12 114/74 A |
| 3,875,886 | A * | 4/1975 | Glasfeld et al. | 114/74 A |
| 4,234,216 | A | 11/1980 | Swanson et al. | |
| 4,315,408 | A * | 2/1982 | Karl | F16L 11/22 138/107 |
| 4,604,961 | A * | 8/1986 | Ortloff et al. | 114/230.12 |
| 5,146,863 | A * | 9/1992 | Ford | 114/67 A |
| 5,194,164 | A * | 3/1993 | Adams | 210/776 |
| 5,339,760 | A * | 8/1994 | Korsgaard | 441/3 |
| 5,380,229 | A * | 1/1995 | Korsgaard | 441/3 |
| 5,509,838 | A * | 4/1996 | Breivik et al. | 441/5 |
| 5,564,957 | A * | 10/1996 | Breivik | B63B 22/026 114/230.2 |
| 5,697,732 | A * | 12/1997 | Sigmundstad | 405/169 |
| 5,762,342 | A | 6/1998 | Kakabaker et al. | |
| 5,878,814 | A * | 3/1999 | Breivik et al. | 166/267 |
| 5,983,931 | A | 11/1999 | Ingebrigtsen et al. | |
| 6,298,671 | B1 * | 10/2001 | Kennelley | F17C 1/002 62/50.2 |
| 6,367,522 | B1 | 4/2002 | Tyer | |
| 6,443,166 | B1 | 9/2002 | Tunney et al. | |
| 6,623,043 | B1 * | 9/2003 | Pollack | 285/121.2 |
| 6,793,740 | B1 | 9/2004 | Tunney et al. | |
| 6,926,776 | B1 | 8/2005 | Tunney et al. | |
| 7,174,931 | B2 * | 2/2007 | Espinasse | B63B 22/021 141/387 |
| 2002/0104581 | A1 * | 8/2002 | Drube | F17C 5/02 141/82 |
| 2004/0036275 | A1 | 2/2004 | Pollack | |
| 2004/0115005 | A1 * | 6/2004 | Baan | 405/169 |
| 2005/0039665 | A1 * | 2/2005 | Wille et al. | 114/230.14 |
| 2005/0279266 | A1 * | 12/2005 | Secretan | B63B 19/08 114/117 |
| 2007/0264889 | A1 * | 11/2007 | Boatman et al. | 441/5 |

FOREIGN PATENT DOCUMENTS

| | | | |
|---|---|---|---|
| DE | 43 20 759 | A1 | 1/1995 |
| EP | 0 157 186 | A2 | 3/1985 |
| EP | 1157186 | | 11/2001 |
| EP | 1 353 114 | A2 | 10/2003 |
| GB | 1348318 | A * | 3/1974 |
| NO | 137376 | | 6/1973 |
| NO | 141840 | | 11/1977 |
| WO | WO 99/38762 | | 8/1999 |
| WO | WO 01/34460 | A1 | 5/2001 |
| WO | WO 2004048191 | A1 * | 6/2004 |

* cited by examiner

CRYOGENIC FLUIDS TRANSFER SYSTEM WITH TRANSFER SPILLS CONTAINMENT

FIELD OF THE DISCLOSURE

The present invention regards a system for transferal of at least a cryogenic fluid between two objects, for instance an installation and a vessel.

BACKGROUND

A cryogenic fluid, typically LPG or LNG, has a very low temperature at ambient pressure when stored as a liquid. If this liquid is spilled at or in a vessel all equipment in the vicinity of the spilled liquid will be cooled down to the boiling temperature of the liquid, which for LPG can be typically −50 degrees C. and for LNG typically −164 degrees C. Most vessels and equipment are built of carbon steel that will turn brittle and loose its structural strength at cryogenic temperatures.

Almost all present transfer of LNG from shore to ship or ship to shore or between ships is performed by means of chicksan type loading arms. The arms are located on the quay and the receiving/transfer piping on the manifold located midship on the LNG transportation vessel. The arms and the piping are located outdoor and any spillage will be collected in drip pans underneath the connection point. The main purpose of the drip pans is to collect any liquid spillage and direct it to special storage tanks and to prevent cold liquid to fall onto the steel structure of the vessel. A rapid cool down of the vessels steel structure will cause the steel to be brittle leading to mechanical break-down either due to thermal stress (contraction of part of the part due to low temperature) or mechanical stress (due to reduced strength of the material at low temperature). Any boil off will evaporate to the atmosphere or into a specific system for boil off.

In future transfer systems LNG may be carried through closed spaces inside the ship. This could be for instance in the OCL (Offshore Cryogenic Loading) LNG transfer system, where LNG is received in a purpose built structure in the bow of the ship, in compartments used to transfer LNG to the propulsion or generator motor or in a swivel compartment for instance described in WO 99/38762 or WO 01/34460. There may be further use of transfer of cryogenic fluids from one floating vessel to another floating vessel, by for instance a submerged buoy system, which gives other demands for the transfer system.

The cryogenic liquid is maintained at or close to its boiling point at low temperature and any contact with other material at a higher temperature will result in transfer of heat from the material to the liquid and boil-off of liquid and cool down of the material. The liquid is therefore normally stored in well insulated pipes and tanks and all transfer is carried out with dedicated equipment and according to pre-determined and approved procedures to reduce the risk of spill and accidents.

Another issue in relation to the transfer of cryogenic fluid is that any human exposure to the liquid or cold gas may result in serious injury or death. Protection of personnel can be achieved by either prohibiting personnel to enter the area when cold media is present and can leak out, or by use of adequate protective equipment. At this time protective equipment is limited to space suits and similar clothing which by nature is either prohibitive expensive or not available at such sites. As a general rule unprotected personnel should therefore not be admitted to enclosed spaces where there is a possibility that LNG may escape (from for instance rotating equipment or flanged connections). Equipment inside such space must therefore be remotely operated and monitored and all containers with cryogenic liquid must be drained and inerted before personnel can enter.

Cryogenic liquids are normally not corrosive or destructive to the environment other than by cooling down all exposed material to low temperature and replacing the atmosphere by the product liquid and gas. Cryogenic liquids are normally of a low specific gravity (typically less than 0.5 kg/l) and will float on top of most other liquids. Loose material will tend to sink in the liquid. The boil-off gas will at ambient temperature (+10 degrees C. to say 50 degrees C.) normally be lighter than air and will therefore tend to move upwards and mix with air. However, Boil-off gas at very low temperature will be heavier than air at ambient temperature. A release of cryogenic fluid inside an enclosed compartment will therefore tend to form cold product gas at the bottom and expel the original atmosphere at the top. As the product gas heat up it will tend to rise upwards in the compartment. Removal of product gas should therefore be performed by blowing in air (or inert gas) at as high temperature as practical to evaporate liquid spill and to heat up and expel the cold gas.

As long as liquid cryogenic fluid is present it will exist at its boiling temperature at the actual ambient storage pressure. Any input of heat will result in boil-off and if no heat is added the temperature of all exposed material will fall until the boiling temperature of the liquid has been reached, where after the boil off will be reduced to equalize the heat influx. Equipment inside a compartment can be protected from the low temperature by insulation or by adding heat to the equipment, typically by heating coils or resistance heating elements wrapped around the sensitive parts. Insulation of free standing equipment inside the enclosed space will have a practical limitation in protection time if no heat is added, as it is not possible to insulate any equipment perfectly. With time the equipment inside the insulation will be cooled down to the boiling temperature of the liquid on the outside.

Parts that are insulated on the outside and where heat is added on the inside can be maintained at any desired temperature for any period of time as long as the flow of heat supplied is higher than the heat removed on the exposed side of the insulation. Transfer of heat from one media to another is either done by radiation through vacuum or a gas or by heat flow through the material. Vacuum is the best insulation and reflective material is used together with vacuum, or almost vacuum, to reflect heat radiation. Most insulation principles are therefore based either on vacuum, reflective material or fixed foam, or gas which is a better heat insulator than solid material.

All these measures do not give a satisfactory system for transferal of cryogenic fluid between two units.

SUMMARY

An aim of the present invention is to provide a system for transferal of at least one cryogenic fluid, which is safer in respect of protection of personnel, in the case of any spillage of fluid and or in the protection against possible spillage of fluid.

It is also an aim to provide a transfer system which is safe but gives room for flexible solutions.

Another aim is to provide a specifically good solution for the case where one has transfer of cryogenic fluids between an installation and a floating vessel or between two vessels, where at least one of them has a single mooring point, and the transfer pipes runs through the single mooring point.

The present invention as defined in the following claims provides a system that fulfils the above mentioned aims.

According to a first aspect of the invention the system regards transferal of at least one cryogenic fluid between two objects for instance an installation and a vessel. At least one transfer pipes is extending from the one object, the installation and into a receiving room in the other object, the vessel. These transfer pipes are connectable with piping on the vessel through connection means in the receiving room. According to the invention the receiving room is closable for instance for human entry during transfer. Closable should in this application be interpreted to mean fully closed, as sealed off in relation the surroundings or closed off for human entry into the surroundings of the transfer elements, but with an aperture in the mainly vertically highest points for evacuation of eventual boil off to the atmosphere. The aperture is however positioned in a manner and in a distance from any position personnel may be in during transfer to keep them from harm in case of a leakage, for instance above an upper deck level. The connection means, at least a part of the receiving room and or other elements in the receiving room comprises means to withstand eventual leakage of the cryogenic fluid and the system also comprises means for evacuating the receiving room for eventual spilled fluid.

The cryogenic fluid may be LNG or LPG or other cryogenic fluid, and the system may also comprise possibilities for transfer of other fluids or media. The objects may be a land based installation and a floating vessel, two vessels, an underwater installation and a vessel, a vessel and a floating platform, or similar constellations. The floating object, as a vessel or a floating platform, may have a fixed mooring to the seabed as a tension leg platform or have a single point mooring system which may be releasable.

In a preferred embodiment at least a part of the walls, roof and or floor construction of the receiving room is formed with insulation voids in the construction and or covered with an insulating material and or formed with a more cold resistant material than the rest of the vessel. In one embodiment one may also add heat to the elements forming the room or elements within the room. The possibility of forming the elements within and at least parts of the receiving room in for instance a material such as stainless steel (typically AISI 304/316, Duplex Stainless Steel), aluminium or "plastic" material such as Teflon or similar, which are not suitable for forming the rest of the vessel of, would give the needed cold resistance in case of spillage of cryogenic fluid within the receiving room. There are of course other possible materials which fulfils the needed properties which are not mentioned here. The possibility of having only a limited, well defined area which needs the specific properties gives large benefits both with regard to economy and security for the transfer system.

Having the receiving room closable, gives the benefit of having a well defined area for limiting the eventual spilled cryogenic fluid. It also gives the possibility of adding a fluid for instance an inert gas, as nitrogen into the room during transfer, and or the possibility of easy cleaning of the room after an eventual spillage of fluid. Another issue is that the room may have locking means linked to the transfer operation which prevent personnel from entering the room during transfer.

In one embodiment the transfer pipes and or piping on the vessel are at least doubly mantled, with vacuum and or a specific gas at a pressure equal to or larger than the pressure within the pipe or piping, in the voids between an inner and an outer mantel of the pipes. This may also in one embodiment be the case for the voids in the construction of the receiving room structure. The gas may for instance be nitrogen or an inert gas. Heat may also be artificially added by circulating heated gas or by use of for instance electric heating elements.

In a specific embodiment of the invention the pipe from the installation goes through a turret arrangement, which may form a single mooring point for the vessel. The turret may be arranged amidships or in the bow or stern of the vessel. The turret arrangement is arranged on bearings on/in the vessel, the connecting means being swivel means, where at least a part of the turret and or at least a part of the construction forming the receiving room are formed with voids with vacuum/gas or formed with other insulation means to withstand eventual spillage.

In a preferred embodiment of the invention the turret is releasable attached to the vessel, and may be a submerged buoy with a turret releasable arranged in receiving means, arranged at the vessel close the bottom of the hull. The receiving means being a part of the hull of the vessel which corresponds to the form of a part of the buoy, for instance a truncated cone or partly spherical.

In one embodiment the bearing means and or the locking means for the buoy/turret arrangement are arranged within the receiving room and formed to withstand eventual spillage. In another embodiment they may be arranged outside the receiving room, for instance on deck above or below the receiving room.

The means for evacuating the receiving room may in one embodiment comprises an opening in the bottom of the receiving room leading to a drain tank comprising a pump and piping for moving the spilled fluid back into the system or to another system.

In an embodiment at least a part of the area around the receiving means comprises insulation means in form of an insulation clad and or sections of the hull made to withstand spillage of cryogenic fluid, by forming vacuum or gas voids in the structure forming the hull and or forming the section of the hull by a more cold resistant material than rest of the vessel.

To make sure no cryogenic fluid is trapped beneath the vessel, the hull of the vessel has in one embodiment a part around the receiving means formed with recesses or tunnels for evacuation of eventual trapped cryogenic liquid.

The piping within the receiving room is in one embodiment an articulated piping, for connecting to and releasing of the connection to the pipe from the installation. The articulated piping is in one embodiment formed by introducing swivel means between more or less rigid piping sections.

Flanges and or other connection means between two elements forming a fluid channel in the system, as for instance transfer pipe, piping on the vessel and or connection means, are in one preferred embodiment formed with at least a double seal means arrangement with introduction of a fluid between the double seals, at a pressure equal to or higher than the pressure of the fluid transferred in the elements. The fluid is preferably a gas as nitrogen or another inert gas.

In an embodiment the closable receiving room, when transferring cryogenic fluid through the system is filled with a gas at a pressure equal to or higher than the pressure of the cryogenic fluid, and or cleaned with an inert gas after transferal of cryogenic fluid before personnel may enter the receiving room.

BRIEF DESCRIPTION OF THE DRAWINGS

The invention will now be explained in more detail with reference to the accompanying drawings, where.

DETAILED DESCRIPTION

Figure 1:
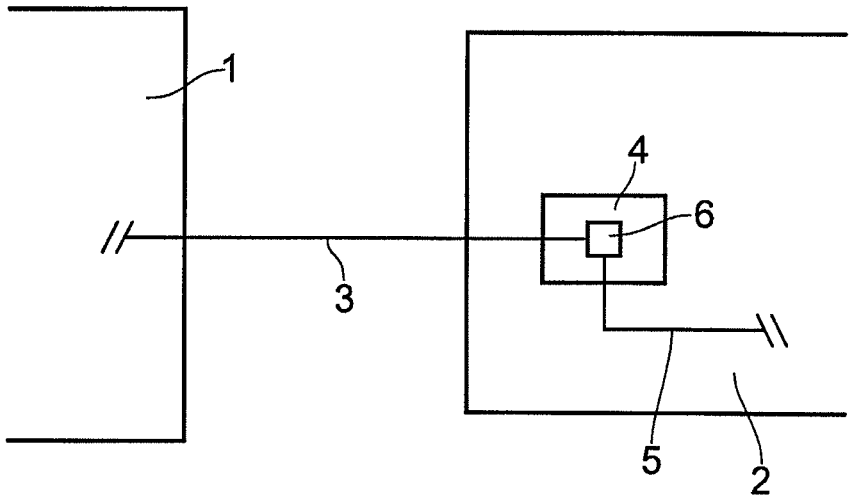
FIG. 1 is a schematic sketch of the principles of the invention.

For clarification similar elements in the different figures and embodiments are given equal reference numerals in all the figures.

The present invention regards a transfer system as schematically shown in FIG. 1. The system comprises transfer pipes from one object, for instance an installation 1 which may be land based, floating in the water or a sub sea installation, to another object 2 which may be a vessel for transport. There are transfer pipes 3 from the first installation to a receiving room 4 on board the vessel 2, where the transfer pipes 3 through connection means 6, are connected to piping 5 onboard the vessel.

As stated above the objects may be of different kind, the receiving room may for a transport vessel be in the bow stern or amidships or between. There may be more than one transfer pipe or piping and one may transfer at least one cryogenic fluid and possible also other fluid and media.

Figure 2:
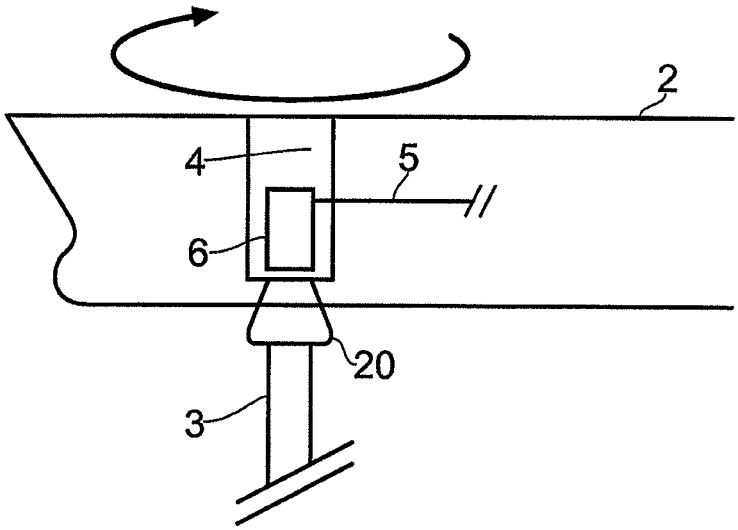
FIG. 2 shows a schematic sketch of a single point mooring system for a vessel used in connection with the invention.

In a preferred embodiment of the invention, it is used in the connection with a vessel which has a single point mooring system, as shown in FIG. 2. The transfer pipe 3 extends from a sub sea installation and or another floating object and in connected to turret means, which in the shown embodiment is a part of a normally submerged buoy 20. The buoy 20 is received in receiving means in the hull of the vessel, for mooring and transfer of fluid. The transfer pipes 3 are through connection means 6, connecting to the piping 5 onboard the vessel 2, in a manner so that the vessel may rotate around the mooring point and the transfer pipes 3 do not experience unnecessary stress. This is a well known mooring and transfer system at sea, where there are weather conditions which demand quick release and an ability to change the position of the vessel dependent on weather and sea conditions.

Figure 3:
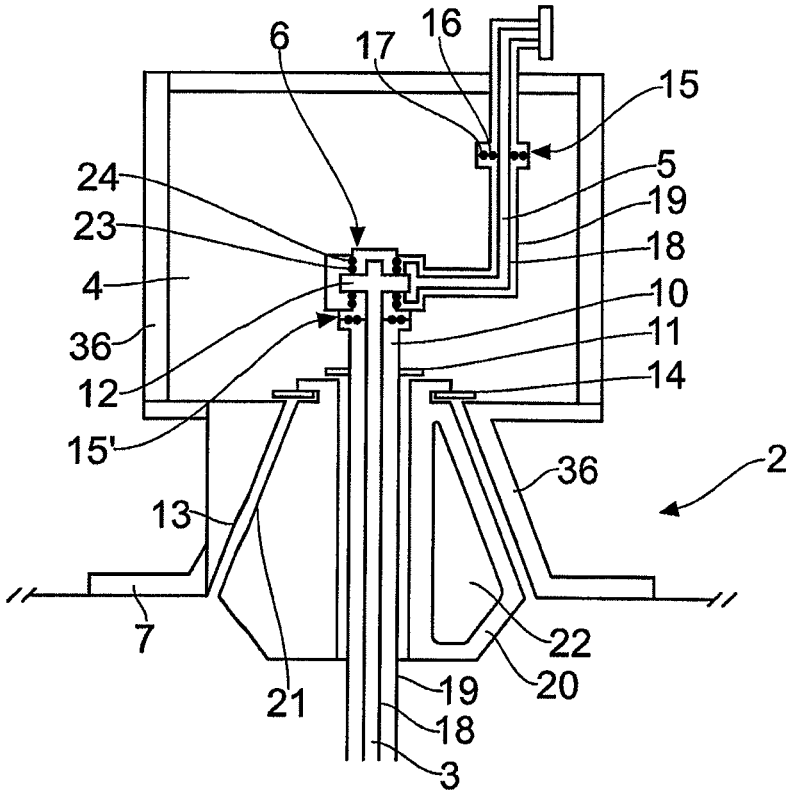
FIG. 3 shows details of a first preferred embodiment of the invention for a single point moored vessel.

In FIG. 3 there is shown a preferred embodiment of several of the details according to the present invention. The transfer pipe 3 is guided through a buoy 20 and connected to the piping 5 onboard the vessel 2 through connection means 6 in a closable receiving room 4. The buoy 20 is formed with a surface section 21, in this embodiment as a truncated cone, corresponding to receiving means 13 provided for in a section of the hull 7 of the vessel 2. The buoy 20 may also be provided with a void 22, for buoyancy and or insulation.

The structure forming the receiving room 4 and a section of the hull 7 are formed with voids 36 in the structure, to provide insulation of the closable receiving room 4 and the hull 7. The insulation may be achieved by vacuum in the voids or adding of a gas. The bearing means 11 for the turret arrangement 10 connected to the buoy 20 and the locking means 14 for locking the turret 10 and the buoy 20 to the vessel 2 are formed in a more cold resistant material.

The connection means 6 are in this embodiment a swivel means 12 with one fluid channel and double seals 23, 24 around the fluid channel. There may of course be swivel means with more than one fluid channel in the system according to the invention.

The transfer pipe 3 and the piping onboard the vessel 2 are formed with a double mantle, with an inner mantle 18 and an outer mantle 19, to insulate the cryogenic fluid pipe and also give security in case of leakage. There are means to provide vacuum and or add a gas to the void between the inner mantle 18 and the outer mantle 19 (these means are not shown). The gas may be nitrogen or another inert gas.

In the embodiment all flanges 15, within the piping 5 or the transfer pipe 3, or between these and the connection means 6, are provided with a double seal, with an inner seal 16 and an outer seal 17. There are (not shown) means to provide a fluid in the void between the two seals, for instance gas, as nitrogen or another inert gas.

This fluid between the seals or in the void between the mantles or in the structure of the receiving room 4 and or the section of the hull 7 may be added at a pressure equal to or higher than the pressure of the fluid to be transferred.

Figure 4:
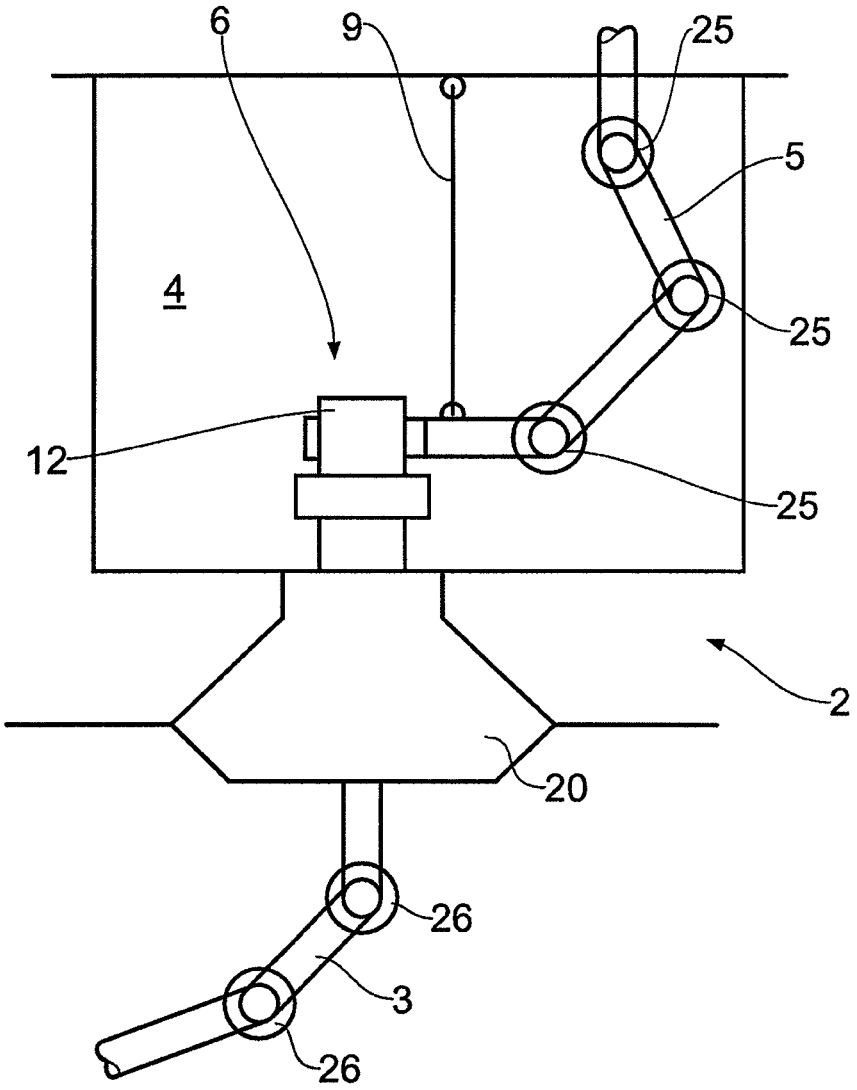
FIG. 4 shows a second detail related to articulated piping onboard the vessel of an embodiment of the invention.

FIG. 4 shows another embodiment of the transfer pipe 3 and the piping 5 onboard the vessel 2 in comparison with the details shown in FIG. 3. The piping 5 is in this embodiment an articulated piping 5 comprising pipe swivel joints 25 within the receiving room 4. Also the transfer pipe 3 is articulated with pipe joints 26.

Figure 5:
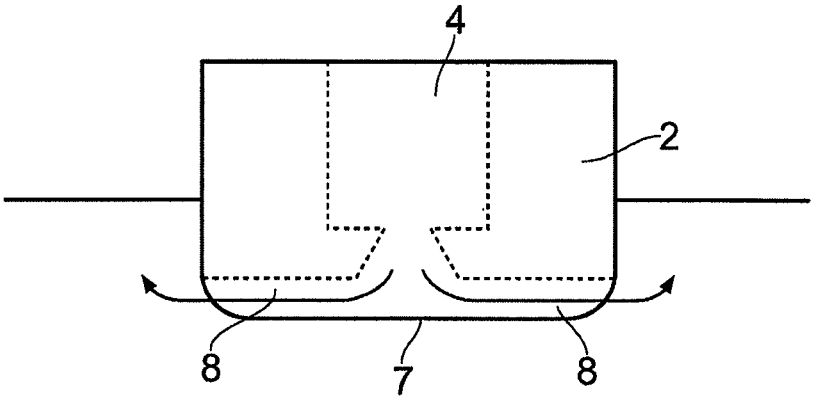
FIG. 5 shows a third detail of the hull in an embodiment of the invention.

FIG. 5 depicts another detail of the system according to the invention. The hull 7 of the vessel 2 are, from beneath the receiving room 4 and out to the sides of the vessel formed with recesses or channels 8, for releasing of eventual trapped cryogenic fluid beneath the vessel.

Figure 6:
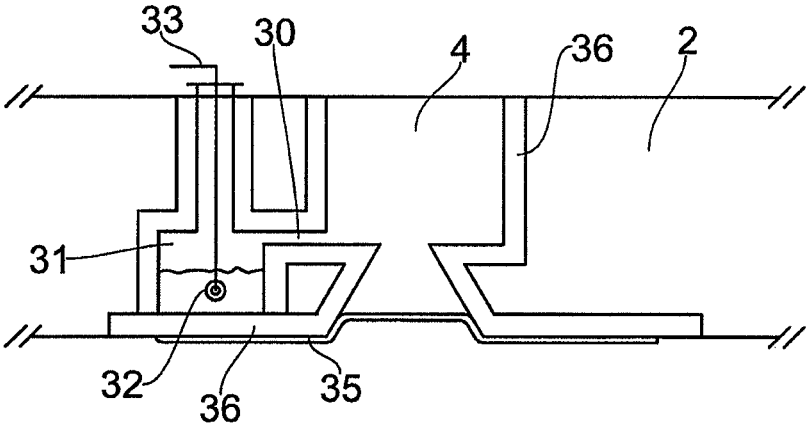
FIG. 6 shows a fourth detail of evacuation means for spilled fluid.

In FIG. 6 it is shown an embodiment of a detail of the invention for evacuation the receiving room 4 of eventual spilled cryogenic fluid. The evacuation means comprise an opening 30 in the bottom of the receiving room 4, which opening leads to a tank 31. There are within the tank 31 a pump 32 and spillage piping 33 for transfer of the cryogenic fluid from the tank back to the system and or to another system. Both the receiving room 4 and the tank 31 are formed with insulation voids 36 in the structure forming the receiving room 4 and the tank 31. The section of the hull 7 beneath the receiving room is in this embodiment also formed with an insulating cladding 35.

Figure 7:
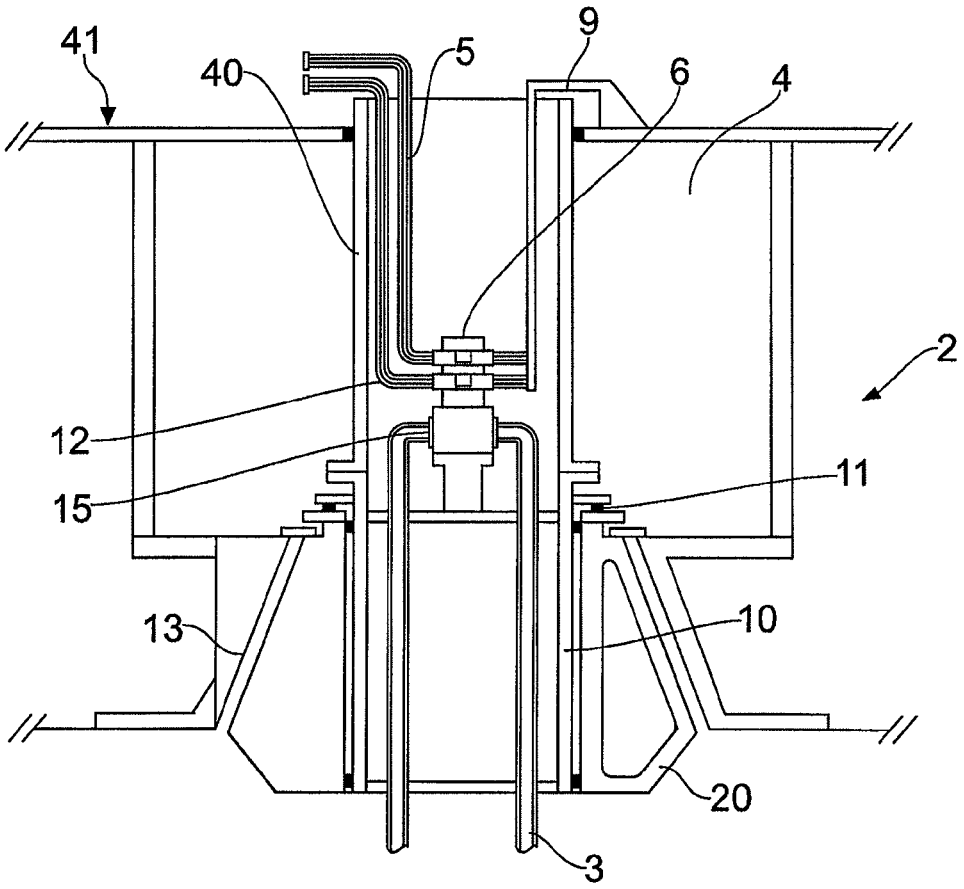
FIG. 7 depicts a second embodiment of the details showed in FIG. 3.

FIG. 7 depicts another embodiment of the details of the invention which are shown in FIG. 3. We will here only describe the differences and not the elements which are similar and already described with reference to FIG. 3. There is in this embodiment two transfer pipes 3, connection means 6 for these two pipes to two sets of piping 5 onboard the vessel 2, which all are doubly mantled as in the embodiment shown in FIG. 3. In the receiving room 4 there are in addition arranged a closable cylinder cover 40 around the connection means 6 comprising flanges 15 and swivel means 12. The cylinder cover 40 extends from the turret means 10 and up to the deck 41 of the vessel 2. By having the cylinder cover extending above the deck 41 it may be kept open at the top so eventual gas of spilled cryogenic fluids may evaporate to the environment. The embodiment also shows lifting means 9 for eventual lifting of the connection means 6 and or the piping 5 and cylinder cover 40 into contact with the transfer pipe 3 from the other installation, when the buoy 20 and the turret means 10 are brought in contact with and positioned within the receiving means 13 in the vessel 2.

Figure 8:
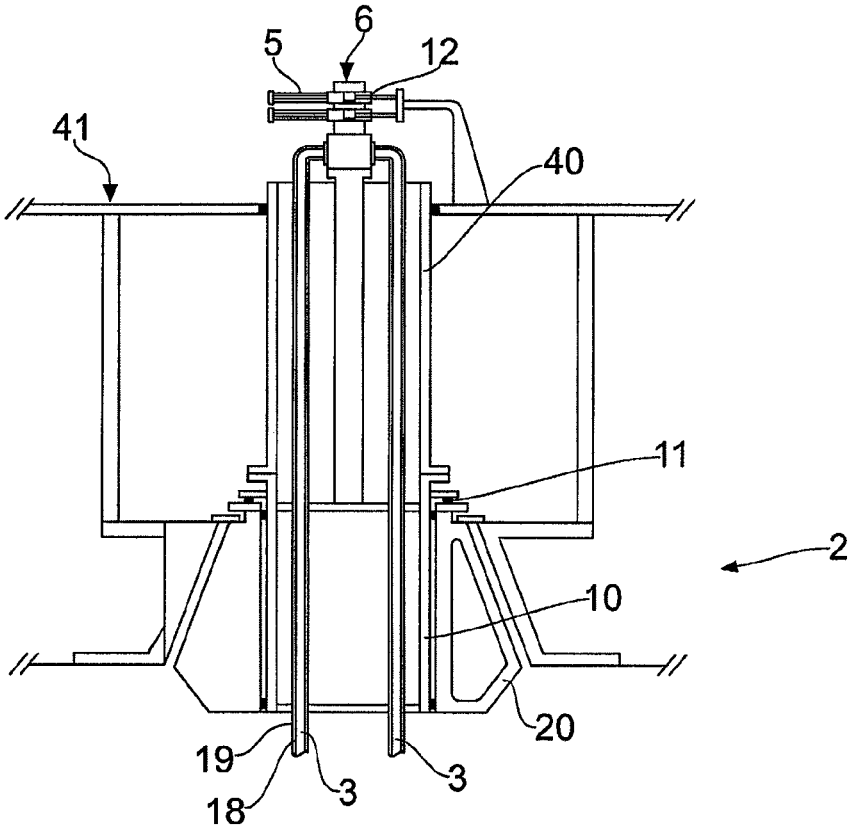
FIG. 8 depicts a third embodiment of the details showed in FIG. 3

FIG. 8 depicts a third embodiment. It is referred to the description of FIGS. 7 and 3 for explanation of similar elements. There is one difference between FIG. 7 and FIG. 8 in the connection means 6, comprising the swivel means 12 are arranged at or above deck level 41. However, any spillage of cryogenic fluid in the swivel means 6 will still be closed off in that personnel will not have access to the area during transfer, and fluid spillage will run down in to the cylinder cover, and boil off evaporate to the atmosphere.

Figure 9:
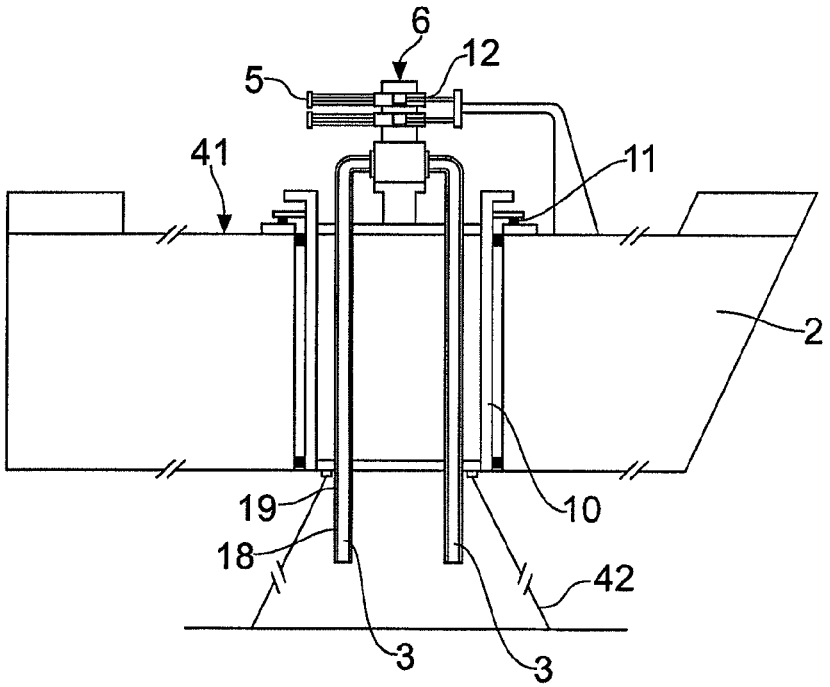
FIG. 9 depicts a fourth embodiment of the details showed in FIG. 3.

FIG. 9 depicts a fourth embodiment, where the turret 10 is arranged as part of the vessel 2. The turret 10 is arranged on bearings 11 close to or at the deck level 41, and is anchored to the sea bed by anchor lines 42. Also in this embodiment is the connection means 6 comprising the swivel means 12 closed off in a similar manner as the embodiment depicted in FIG. 8.

The invention has now been explained with detailed embodiments, there may be envisaged several alterations and modification within the reach of a skilled person, which would fall within the scope of the invention as defined in the following claims. The connection means 6 may be positioned on the vessel, on the turret and or buoy or partly on the turret and partly on the vessel and brought into contact when the elements are correctly positioned. The turret may be a non releasable turret in the vessel. The turret arrangement may be in the bow of the vessel. The system may comprise all the detail described above or a combination of some of them. The receiving room may be filled with an inert gas or nitrogen when the transfer system is used. The system may comprise sensors for sensing loss in pressure in the fluid added to the voids, to detect leakage. The pipes may be triple mantled, and there may be triple seals, where there is gas added only between two of the mantles or seals or between all or vacuum between some and a fluid between the others.

The invention claimed is:

1. A system for transferral of a cryogenic fluid between an installation and a vessel, the system comprising:

the vessel comprising a hull and a receiving room;

a transfer pipe extending from the installation, through an opening in the hull of the vessel, and into the receiving room in the vessel, the transfer pipe being connected, during transfer of the cryogenic fluid, with a piping on the vessel through a connection in the receiving room, wherein the piping extends from the connection to outside the receiving room, wherein the receiving room is closed to human entry during transfer of the cryogenic fluid by a lock;

wherein the connection includes a fluid channel and a seal, and is available to swivel during transfer of the cryogenic fluid;

wherein the connection means and at least a part of a construction forming the receiving room are capable of withstanding a leakage of the cryogenic fluid;

means for evacuating the receiving room to remove the leakage of the cryogenic fluid; and wherein the at least a part of the construction forming the receiving room comprises a wall formed with a plurality of insulation voids that extend within the wall and contain a vacuum or a gas.

2. The system according to claim 1, wherein the transfer pipe and the piping on the vessel are at least doubly mantled and comprising voids, with a vacuum or a gas at a pressure equal to or larger than a pressure within the transfer pipe or the piping, in at least one of the voids between different mantles of the transfer pipe and the piping on the vessel.

3. The system according to claim 2, wherein the insulation voids in the receiving room construction or the voids in the at least doubly mantled pipe or piping are provided with a gas.

4. The system according to claim 1, wherein the transfer pipe from the installation goes through a turret, the turret is arranged on a plurality of bearings atop or within the vessel, the connection comprises a swivel means, and at least a part of the turret is formed with a plurality of voids each containing a vacuum or a gas.

5. The system according to claim 4, wherein the bearings are arranged within the receiving room and formed to withstand the leakage of the cryogenic fluid.

6. The system according to claim 4, wherein the means for evacuating the receiving room comprises an opening in a bottom of the receiving room leading to a drain tank comprising a pump for manipulating the cryogenic fluid.

7. The system according to claim 4, wherein the turret is releasably attached to the vessel.

8. The system according to claim 4, wherein the turret is connected to a submerged buoy, releasably arranged in a receiving means, and arranged at the vessel close to a bottom of the hull.

9. The system according to claim 8, wherein at least a part of an area around the receiving means comprises insulation voids provided with a vacuum or a gas.

10. The system according to claim 8, wherein the hull of the vessel in a part around the receiving means is formed with recesses or tunnels for evacuation of the cryogenic fluid beneath the vessel.

11. The system according to claim 8, wherein the piping in the receiving room comprises an articulated piping for connecting to and releasing a connection to the transfer pipe from the installation.

12. The system according to claim 11, wherein the piping in the receiving room is formed by the articulated piping that comprises the swivel means.

13. The system according to claim 1, wherein the closable and sealable receiving room, when transferring the cryogenic fluid through the system, is filled with a gas at a pressure equal to or higher than a pressure of the cryogenic fluid.

14. The system according to claim 2, wherein the insulation voids in the receiving room construction or the voids in the at least doubly mantled transfer pipe and or piping are provided with an inert gas.

15. The system according to claim 2, wherein the insulation voids in the of the receiving room construction or the voids in the at least doubly mantled transfer pipe and or piping are provided with nitrogen.

16. The system according to claim 1, wherein the system is constructed to transfer the cryogenic fluid as a liquid.

17. The system according to claim 16, wherein the liquid comprises liquefied petroleum gas or liquefied natural gas.

18. The system according to claim 1, wherein the receiving room is constructed and sized to permit human entry therein.

* * * * *